US006297499B1

(12) United States Patent
Fenn

(10) Patent No.: US 6,297,499 B1
(45) Date of Patent: Oct. 2, 2001

(54) METHOD AND APPARATUS FOR ELECTROSPRAY IONIZATION

(76) Inventor: John B Fenn, 4909 Cary St. Rd., Richmond, VA (US) 23226

( * ) Notice: Subject to any disclaimer, the term of this patent is extended or adjusted under 35 U.S.C. 154(b) by 0 days.

(21) Appl. No.: 09/109,887

(22) Filed: Jul. 3, 1998

Related U.S. Application Data

(60) Provisional application No. 60/052,885, filed on Jul. 17, 1997.

(51) Int. Cl.[7] ..... H01J 49/00
(52) U.S. Cl. ..... 250/288
(58) Field of Search ..... 250/281, 282, 250/288, 288 A, 423 R

(56) References Cited

U.S. PATENT DOCUMENTS 5,072,115 * 12/1991 Zhou ..... 250/281
5,130,538 * 7/1992 Fenn et al. ..... 250/282
5,686,726 * 11/1997 Fenn et al. ..... 250/281

* cited by examiner

*Primary Examiner*—Kiet T. Nguyen

(57) ABSTRACT

Sample liquid is supplied to the ion source of an Electrospray Ionization Mass Spectrometer (ESIMS) by capillarity induced flow through a wick element comprising a permeable porous aggregate of fibers or particles of material that is wetted by the sample liquid. This method of liquid introduction eliminates the need for pumps of pressurized gas to drive the flow. It also makes possible the convenient extraction of a representative sample from a stream of liquid flowing at any rate, no matter how large.

17 Claims, 4 Drawing Sheets

Abundance
10
8
4
2
0
$(CH_3)_4N^+$
$(CH_3)_3C_{10}H_{21}N^+$
$(CH_3)_3C_{12}H_{25}N^+$
$(C_4H_9)_4N^+$
$(C_4H_9)_4P^+$
$(CH_3)_3C_{16}H_{33}N^+$
$(CH_3)_3C_{18}H_{37}N^+$
0
100
200
300
400
m/z Abundance
10
8
6
4
2
0
$MH_2^{2+}$
$MH^+$
200
600
1000
1400
m/z Abundance
10
8
6
4
2
0
$18H^+$
12200
12600
500
700
900
1100
1300
m/z

METHOD AND APPARATUS FOR ELECTROSPRAY IONIZATION

This application claims benefit of Provisional Appln. 60/052,885 filed Jul. 17, 1997.

RIGHTS STATEMENT

The research leading to this invention was carried out with government support provided to Virginia Commonwealth University in part under Grant # R01 GM31660 from the National Institutes of Health and in part under Grant # MCB 9496160 from the National Science Foundation. The government has certain rights in the invention.

TECHNICAL FIELD

This invention provides for improvements in mass spectrometric analysis of chemical compounds. In particular it is concerned with providing more effective means of interfacing mass spectrometric detection with separation techniques such as liquid chromatography and electrophoresis. The main problem in such interfacing is to obtain effective transformation of compounds present as solutes in solution to intact gas phase ions and to introduce those ions to a mass analyzer in a vacuum system. Over the past decade so-called Electrospray Ionization (ESI) has emerged as one of the most effective techniques for achieving that transformation. It has emerged that stable and effective operation of conventional ESI sources is readily achieved only when the flow rate, electrical conductivity and surface tension of the sample solution are all relatively low. Unfortunately, separation techniques such as liquid chromatography and electroporesis often work much better with solutions in which these properties have higher values than ESI can very well accommodate. In particular, flow rates for the mobile phase in the most: widely used liquid chromatography protocols are close to one milliliter per minute (mL/min). ESI works best at flow rates below one or two microliters per minute (uL/min). Various techniques have been developed to overcome this incompatibility of flow rates but none of them is very satisfactory. The present invention seems to provide the best yet solution method of overcoming this flow rate incompatibility. It also relieves some of the constraints on surface tension and electrical conductivity.

BACKGROUND OF THE INVENTION

Electrospray Ionization (ESI) of solute species in a volatile liquid solvent is carried out by dispersing the liquid as a fine spray of highly charged droplets in a bath gas. As solvent evaporation shrinks the droplets they pass through a somewhat intricate sequence of steps that leads ultimately to the transformation of polar solute species in the droplet liquid to free ions in the ambient bath gas. Some of the resulting ion-gas mixture can be admitted into a vacuum system where the ions can be "weighed" by a mass analyzer. This combination of ESI with mass analysis in so-called Electrospray Ionization Mass Spectrometry (ESIMS) can produce and weigh intact ions from simple polar molecules as well as from complex and fragile species with molecular weights up to many millions. The ESIM ions of large molecules are multiply charged so their mass/charge (m/z) ratios are low enough for weighing by relatively inexpensive instruments such as quadrupole mass filters and ion traps. Sensitivity is so high that a complete analysis may require only attomols of analyte. These features of the ESIMS technique have brought about an explosive expansion in its use. In the archival journals of 1984 there were only two papers on the subject [M. Yamashita and J. B. Fenn, Journal of Physical Chemistry 88, 4451 and 4471 (1984)]. In 1996 alone there were around 800 papers relating to the mechanisms, procedures and applications of ESIMS. The world population of ESIMS systems, now around 5000, is expected to grow rapidly as they increasingly become the detector of choice for liquid chromatographs of which around 12,000 are sold annually.

To provide some background perspective for the present invention we present a brief operational description of the ESIMS method along with some examples of results. FIG. 1 shows a schematic diagram of an ESIMS apparatus similar to that described in US patents of Labowsky et al (4,531,056) and Yamashita et al (4,542,293). It also resembles the systems described in US Patent of Henion et al (4,861,988) and Smith et al, (4,842,701 and 4,885,706) as well as in review articles [Fenn et al, Science 246, 64 (1989); Fenn et al, Mass Spectrometry Reviews 6, 37 (1990); Smith et al, Analytical Chemistry 2, 882 (1990)]. It will be useful to set forth the essential features of the technique with reference to FIG. 1. Sample solution at a few microliters/minute (uL/min) is injected through hypodermic needle 1 into an opposing flow of bath or drying gas 2 (e.g. a few L/min of warm dry nitrogen) in electrospray chamber 3 whose walls serve as a cylindrical electrode and whose pressure is typically maintained at or near one atmosphere. In the end wall of chamber 3 is glass capillary tube 4 with typical dimensions in mm of: L=180, OD=6, and ID=0.6. The front face of glass capillary tube 4 is metalized and held at a few kV "below" the potential of injection needle 1 which can be at any desired potential including ground. Cylindrical electrode (spray chamber 3) is at a potential intermediate between that of injection needle 1 and metallized face of glass tube 4. The resulting electric field at the tip of needle 1 disperses the emerging liquid into a fine spray of charged droplets. Driven by the field the droplets drift toward the inlet of tube 4, shrinking as they evaporate solvent into the opposing flow of drying gas 2. This shrinking increases each droplet's surface charge density until the so-called Rayleigh limit is reached at which electrostatic repulsion overcomes surface tension and a "Coulomb explosion" disperses the droplet into a plurality of smaller droplets which repeat the sequence of evaporation and explosion. Then the droplets become small enough a charge density below the Rayleigh limit can produce an electric field normal to the droplet surface that is strong enough to evaporate or desorb solute surface ions into the ambient bath gas. This Ion Desorption Mechanism, proposed by Iribarne and Thomson [J. Chem. Phys. 64, 2287 (1976) and 71, 4451 (1979)] is now accepted by many investigators. Others favor a Charged Residue Mechanism (CRM) proposed by Malcolm Dole and his colleagues [J. Chem. Phys. 49, 2240 (1968) and 52, 4977 (1970)]. It assumes that the evaporation-explosion sequence leads to ultimate droplets so small that each one contains only a single solute molecule that becomes an ion by retaining some of that ultimate droplet's charge as the last solvent evaporates.

By whatever mechanism they may be formed, the ions along with the evaporating droplets drift down the field, counter-current to the flow of drying gas to arrive at the entrance of glass tube 4 where some are entrained in dry bath gas that emerges into first stage 5 of a vacuum system as a supersonic free jet. A core portion of that jet passes through skimmer 6 and electrostatic lens stack: 7 delivering ions to mass analyzer 8 in second vacuum stage 9. The ions entering glass tube 4 are in a potential well whose depth is the difference in voltage between needle 1 and the entrance of the glass tube 4. The flow of gas through the glass tube drags the ions up out of said well to any desired potential at the tube exit, even many KV above ground! By this arrangement all external parts of the apparatus are at ground potential, posing no hazard to an operator.

In the system of FIG. 1 just described the counter-current flow of warm bath gas achieves evaporation of droplet solvent and desolvation of the resulting ions before they enter the glass tube leading into the vacuum system containing a mass analyzer. However, there are some variations on this general approach which can also deliver desolvated ES ions to the mass analyzer. Some systems avoid the need for counter-current gas flow and achieve most of the desolvation of droplets and ions by raising the temperature of the mixture of droplets, ions, and bath gas, or a portion thereof, before it enters the vacuum system. One such system passes a portion of said mixture of ions and solvent-containing bath gas through a heated metal tube instead of glass tube 4 of FIG. 1. The metal tube walls are sufficiently hot to raise the gas temperature enough to avoid resolvation of the ions due to adiabatic cooling during the free jet expansion of the ion-bearing bath gas at the exit of the tube by which the ions and bath gas enter the vacuum system. Any residual solvation of the ions can then be eliminated by maintaining a voltage difference between the tube exit and the skimmer. The resulting potential gradient accelerates the ions relative to the neutral bath gas molecules during the free jet expansion, thereby bringing about ion-neutral collisions sufficiently energetic to strip the ions of any remaining solvent molecules. Such a system was originally proposed by Chowdhury, Katta and Chait et al and is described in U.S. Pat. No. 4,977,320 as well as in a paper. [Rapid Communications in Mass Spectrometry, 81 (1990)]. If the conduit for passage of ions and bath gas from the ES chamber into the vacuum is made of a conducting material such as a metal, then there cannot be an appreciable potential difference between the inlet and the exit ends of the conduit. Therefore, the ES injection needle for sample liquid must be maintained at a potential substantially above ground in order to provide a field at the needle tip that is intense enough to electrospray the emerging liquid. In other words the source of sample liquid must itself be floating above ground or else provision must be made to raise the sample liquid from ground to the needle potential which may be several KV above ground. This requirement can introduce some design problems when, the source of sample liquid is a liquid chromatograph.

Some systems have only one vacuum stage which is provided with enough pumping speed to accommodate the entire flow of gas from the electrospray region while maintaining the background pressure low enough for satisfactory operation of the mass analyzer. In one such single stage system much of the ion desolvation is achieved by means of a potential gradient in the jet as described above. Still other systems incorporate one or more additional stages of pumping between the first vacuum stage (5 in FIG. 1) and the final vacuum stage (9 in FIG. 1) containing the mass analyzer (8 in FIG. 1). In some systems the conduit through which ion-bearing bath gas passes from the electrospray region into the vacuum system is a simple orifice instead of a tube. Common to all systems is the electrospray region or chamber in which the sample solution is dispersed into a bath gas at a pressure high enough so that the mean free path is small relative to the diameter of the exit aperture. In other words the bath gas must be dense enough to provide the enthalpy required to evaporate solvent from the ES droplets and to slow down ion mobility enough to prevent space charge from dispersing the ES ions to such a low concentration in the bath gas entering the vacuum system that the mass analyzer can't provide useful signals. At present the pressure of bath gas in most ESIMS systems is at or near one atmosphere but some investigators have been exploring the possibility of carrying out ESI at much lower pressures. The present invention relates primarily to what goes on in the electrospray chamber before the ion-bearing gas enters the conduit into the vacuum system. Consequently, it should be equally applicable in most ESIMS systems no matter what configuration is used downstream of the ES chamber.

ES ions are believed to be formed from the excess cations (or anions) on a droplet that give rise to its net charge and thus to the current carried by the spray. Those excess cations or anions are believed to be distributed on the surface of their source droplets. They may be alone or in aggregation with normally neutral solute or solvent molecules containing one or more polar groups to which an excess anion or cation can be bound by forces due to charge-induced dipoles, hydrogen bonds, or dispersion. It is these surface ions or ion-neutral aggregates that according to the Ion Evaporation Model (IEM) are desorbed by the droplet's surface field into the ambient gas. FIG. 2 shows some examples of early ESIMS spectra obtained with the apparatus of FIG. 1. Panel 2A is the mass spectrum for a mixture of tetra alkyl ammonium or phosphonium halides at concentrations from 2 to 10 ppm in aqueous methanol. This spectrum was the first proof that ESI could make ions from species that cannot be vaporized without catastrophic decomposition. The spectral peaks of FIG. 2-B are for the decapeptide gramicidin S whose basic groups attach solute protons. It is noteworthy that the dominant peak is for ions with two charges rather than one.

FIG. 2-C shows an ESMS spectrum for the protein cytochrome-c, typical of spectra for molecules large enough to require multiple charges for "lift off" by the droplet field. The charges on ES ions of proteins and peptides are usually protons. The ions of each of the multiple peaks differ from those of adjacent peaks by a single charge (proton). Because of this coherence each peak becomes in effect an independent measure of the molecular weight Mr of the parent species. Mann, Meng and Fenn [U.S. Pat. No. 5,130,538; Analytical Chemistry 61, 1702 (1989)] introduced computer algorithms that can integrate and average the contributions from each peak to arrive at a most probable value of Mr, more accurate and reliable than can be achieved for large molecules by most other techniques. The inset in FIG. 2-C shows the result of such a deconvolution for the illustrated spectrum. The ordinate scale is the same for both the deconvoluted spectrum in the inset and the original experimental spectrum. Clearly, both the effective "signal" and the signal/noise ratio are substantially higher in the deconvoluted spectrum.

Microscopic examination of a stable spray shows that the liquid emerging from the tip of the spray needle forms a conical meniscus known as a Taylor cone in honor of G. I. Taylor whose theoretical analysis predicted that a dielectric liquid in a high electric field would take such a shape. In the case of conducting liquids a fine filament or jet of liquid emerges from the cone tip and breaks up into nearly monodisperse droplets whose initial diameters are slightly larger than the diameter of the jet. Sprays produced under these circumstances are sometimes referred to as "cone-jet sprays." It turns out that to obtain a stable cone-jet electrospray which produces a high yield of solute ions one must achieve an optimum balance between flow rate and applied field. Moreover that optimum balance depends very strongly on the properties of the sample liquid, in particular its electrical conductivity and its surface tension. In general, the higher the conductivity and surface tension, the lower must be the flow rate. In most ESI systems the sample liquid enters the needle at a fixed flow rate determined by a positive displacement pump. In some cases it is convenient to achieve such a fixed flow rate by pressurizing a reservoir of the sample liquid with gas. The liquid flows through a conduit long enough and narrow enough to require a high pressure difference between the source and the exit of the spray needle to maintain the flow. If that pressure difference is very high relative to the pressure at the needle exit, minor pressure fluctuations at the needle tip or in the ES chamber will not affect the liquid flow rate. Thus a steady flow can be maintained at a desired value by appropriate choice of reservoir gas pressure. If the liquid flow rate is higher than the rate at which the electric field can extract liquid from the tip of the Taylor cone, excess liquid accumulates at the base of the cone and periodically departs as a large droplet that interrupts the cone and the spray until enough liquid accumulates to re-establish the cone-jet spray, whereupon the same interruption recurs. If the liquid flow rate is too small the electric field extracts liquid from the tip of the Taylor cone faster than new liquid comes into the base. Therefore, the cone liquid is depleted and the spray stops until enough new liquid accumulates to start again. Even for solutions of analytical interest that are readily sprayable, i.e. have values of surface tension and conductivity that are not too high, it becomes increasingly difficult to obtain stable sprays at flow rates much above about 20 uL/min or so. Best results are generally obtained at flow rates below about 10 uL/min. The maximum flow rate for spray stability depends strongly upon the electrical conductivity of the liquid. The higher the conductivity, the lower is the maximum flow rate for a stable spray.

It has generally been found over a wide range of liquid flow rates that analytical sensitivity increases as liquid flow rate decreases. That is to say the lower the flow rate of a particular sample liquid into the spray, the higher will be the mass-selected ion currents for analyte species in that liquid and/or the higher will be the fraction of analyte species in the liquid that is converted into free ions. Because lower flow rates result in a lower consumption of sample liquid, the overall analytical sensitivity is generally much higher at low flow rates. The reasons for this effect are not entirely clear but are probably due to the decrease in droplet size that results with decreasing flow rate. Small droplets evaporate more quickly and completely than large ones. Moreover, the spray current does not decrease linearly with flow rate so that droplet charge/mass ratio goes up as flow rate, and therefore droplet size, go down.

These restrictions on flow rate, surface tension and conductivity along with the difficulties in achieving and maintaining the right balance between them, constitute substantial handicaps in many applications for which the many advantages of ESIMS are much to be desired. For example, one of the most attractive and important of these applications is as an interface between a Liquid Chromatograph and a Mass Spectrometer in what is commonly referred to as LCMS analysis. The ability of mass spectrometry to identify the species forming a peak in the effluent from a liquid chromatograph has greatly expanded the scope and power of both techniques. Unfortunately, standard practice in LC has long been based on column flow rates of one mL/min whereas stable electrosprays are readily obtainable only with flow rates less than 20 or so uL/min. In recent years LC at much lower flow rates has been increasingly practiced but many large scale users of LC, e.g. the pharmaceutical industry, have very large investments in equipment and protocols based on LC at one mL/min flow rate. These LC users do not welcome the prospect of writing off that investment and undertaking the formidable task of investing in new equipment and developing protocols that will work at flow rates of a few uL/min. Moreover, when one goes to very low flow rates in LC the tolerance of the equipment and the process for impurities and dirt decreases markedly. For these and other reasons it seems likely that LC at relatively high flow rates is likely to be practiced for a long time. Another problem in LC-ESIMS is that the mobile phase in LC is frequently not readily sprayable because of high conductivity and/or surface tension. For all these reasons, and others, there have been substantial efforts on the part of many investigators to make ESI work with flow rates, surface tensions and conductivities that are much higher than it likes.

An effective approach to the problems caused by high surface tension and conductivity in the sample liquid was introduced by R. D. Smith and H. R. Udseth [U.S. Pat. No. 4,885,076]. They provided a small annular or "sheath" flow of an "ES friendly" liquid around the flow of sample liquid emerging from the injection needle. For example, it is very difficult to obtain a stable electrospray with high conductivity solution of analyte in water, especially at a flow rate of five or ten uL/min. However, a stable spray is readily obtained if one provides a small sheath flow of methanol, ethanol or other sprayable liquid.

The problem of obtaining stable sprays at high flow rates is not so easily solved. One almost obvious possible solution to this problem is to divide the effluent flow from the LC into a small stream and a large one. The small stream comprises a flow rate of a few uL/min or less, suitable for ES dispersion to produce ions for mass analysis. The large stream, comprising the remainder of the LC effluent, can be simply discarded or diverted to an autosampler for collection of the fractions (peak species) that might be used for other purposes. Such flow splitting of a primary flow of one ML/min is not hard to achieve when the minor fraction is a few tens of uL/min or more but becomes much more difficult when the minor fraction is another factor of ten smaller, i.e. only a few uL/min. Positive displacement differential pumping is not an easily performed option when one stream has a flow rate that may be hundreds of times larger than the other. In such cases the usual approach is to divide the flow by a tee or Y into two channels which have different lengths and or different flow areas. Thus, for the same pressure drop across both channels the flow rate in the narrower and/or longer channel will be smaller than in the larger one. To divide a one ml/min flow rate so that one channel will carry only 10 or so uL/min, the flow area of its channel must be so small that to prevent partial or even total plugging becomes a serious problem. Moreover, small differences in temperature between the two channels can make substantial differences in liquid viscosity giving rise to changes in the split ratio. Seemingly appropriate flow splitters are available but they are expensive and not entirely dependable unless extreme care is taken to maintain conditions in both legs very constant for long periods of time, not an easy task. For these any other reasons such flow-splitting has not been a very satisfactory option.

One of the most widely used "fixes" for high flow rates is to provide a "pneumatic assist" to the electrostatic forces that are responsible for the dispersion of sample liquid in "pure" electrospray Thus, an annular flow of high velocity gas surrounds the sample liquid emerging from the injection needle and helps in the nebulization. This pneumatically assisted electrospray was tried by Dole et al in their pioneering experiments (references cited) but did not increase the apparent ion current and so was abandoned. A. D. Bruins, L. O. G Weidolf and J. D. Henion [Anal. Chem. 59, 2647 (1987); J. D. Henion, T. R. Covey, A. P. Bruins [U.S. Pat. No. 4,861,988] were the first to show that this pneumatic assist did make possible the electrospray dispersion of sample liquids flowing at rates up to one ml/min. They called the combination "IonSpray" a term which became a trade name for a commercially available system. Another approach, developed by C. M. Whitehouse, S. Shen and J. B. Fenn [U.S. Pat. 5,306,412], is to use mechanical vibration of the injection needle at ultrasonic frequencies to help disperse the liquid. Both of these methods are able to produce charged droplets at high flow rates with liquids that are difficult to spray, but in both cases the analytical sensitivity (MS Signal) tends to be substantially less than pure ES at low flow rates can provide for the same solution. The reason is that the increase in flow rate that these "assists" allow is not accompanied by a concomitant increase in spray current. Consequently, the charge/mass ratio of the initial droplets decreases as flow rate increases so that a smaller fraction of the analyte molecules is transformed into ions and the selected ion current (MS signal) is decreased for each species. In many cases the decrease in MS signal can be tolerated so that aerodynamic or pneumatic assistance of ES dispersion, which is somewhat simpler and more rugged than ultrasonic mechanical vibration, has become widely used. Although these aerodynamic or mechanical "assists" can often produce useful sprays with liquids having high surface tension and conductivity, for particularly refractory liquids they are sometimes used in conjunction with the sheath flow of an "ES friendly" liquid as described above. To be remembered is that in either of these high flow methods all or most of the LC effluent is dispersed as a spray but only a small portion of that effluent evaporates completely and passes into the vacuum system. Therefore, provision must be made to remove the remainder of the liquid and/or pneumatic gas from the spray chamber. Because all the LC effluent is dispersed in the spray chamber the peak fractions cannot very well be recovered intact as cam be done with an an effective splitter.

BRIEF DESCRIPTION OF THE INVENTION

The present invention embodies effective means and methods for overcoming many of difficulties encountered in the ESI of liquids having the high flow rates, surface tensions and conductivities that complicate and inihibit the practice of ESIMS, as described above. It is based on our discovery that capillarity rather than hydrostatic pressure or a pump can be a particularly advantageous method of supplying sample liquid for dispersion by a strong electric field.

A key characteristic of flow driven by capillarity forces is that those forces can drive the liquid only to the extremity of the capillarity element. Thus, for example, if a wick comprising a strip of filter paper or cloth is suspended with one end dipping beneath the surface of water in a beaker, water will migrate through the wick, driven by capillarity. If the wick is jacketed or the ambient gas is saturated with water vapor so there is no evaporative loss of water from the wick, then the capillarity driven flow of water will cease when the wick becomes saturated with liquid, i.e. is wet throughout its length. If the surrounding gas is not saturated with water vapor then water will be lost from the wick by evaporation and the flow of water up the wick by capillarity will continue at a rate just sufficient to compensate for the evaporative loss and the wick will remain saturated with liquid. If the wick is long enough to reach over the rim of the beaker and hang down the outside so that its end is at or below the surface level of the water in the beaker, then water will drip from the end of the wick and capillarity driven flow will continue from the beaker water through the wick until the beaker water is so depleted that it loses contact with the wick. In short, in a wick that is in contact with a source of liquid, capillarity can maintain flow from the source through the wick at a rate just sufficient to compensate for any loss of liquid from the wick. That capillarity driven flow will cease when there is no longer any loss of liquid from the wick or when the wick loses contact with the source liquid, whichever comes first. Familiar examples in which this self-balancing feature of wick flow occurs include candles and oil lamps. In those devices the flame that provides the illumination at once consumes the liquid fuel evaporating from the wick and supplies the heat required to maintain that evaporation. A tacit assumption in this description of wick flow is that the liquid wets the wick. Clearly, for example, capillarity driven flow of water will not take place through a wick of teflon fibers which are not wet by water. Similarly, a hydrocarbon liquid such as heptane will not flow by capillarity through a cotton wick that is wet with water. OF course, hydrostatic pressure can overcome a lack of wettabily and thus force flow through a wick that is not wet by the flowing liquid as in so-called "Reverse Phase Liquid Chromatography" The subject invention relates to flow through a wick of liquid that wets the wick substance and is driven by capillarity. Indeed such a flow can overcome some resisting forces, for example gravity in the case of a vertical wick. However, gravity does place a limit to the height that capillarity can drive the liquid.

The invention takes advantage of the self-balancing feature of capillarity-driven flow through a wick, namely that such flow will occur only at a rate sufficient to replace liquid that is removed In the application to ESIMS the removal of liquid is by the electric field that disperses sample liquid at the wick tip into a fine spray of charged droplets. Thus, in the practice of the invention one end of the wick is in contact with a source of sample liquid, the other end faces a "counter electrode." A potential difference between the wick and the counter electrode creates the field at the wick tip. The required potential difference is created by connecting the wick to one pole of an appropriate power supply, the other pole of which is connected to the counter electrode. A wick wet with sample solution is a good conductor of electricity so that the wick connection to the power supply can be made anywhere along the wick or to the source of sample liquid. The resulting field draws liquid at the tip of the probe into a cone-jet configuration from which liquid flows into the spray. With wicks of very small dimensions it is sometimes not possible to see the cone-jet configuration of liquid at the wick tip. Even so one can usually detect a measurable spray current between the wick and the counter electrode and a slow but measurable flow of liquid. These phenomena indicate that a cone jet or its equivalent is producing charged droplets and ions. Numerous experiments have clearly shown that with wick injectors both total currently in the spray and selected ion currents at the detector of the mass analyzer are remarkably steady even with liquids having high conductivities and/or high surface tensions. To obtain and maintain well controlled flow rates at the low levels required for spray stability with such liquids is not always readily accomplished with pumps or pressurized-liquid sources. Thus, the wick injection of the invention provides for convenient and effective ESIMS on sample liquids flowing at high rates and comprising water with relatively high concentrations of electrolyte. Prior to the invention, successful ESI under these conditions has required the application of gas dynamic forces and/or sheathe flows of electrospray-friendly liquids usually at a cost of decreases in both convenience and analytical sensitiviy.

BRIEF DESCRIPTION OF THE DRAWINGS

The essential features and advantages of the invention can be readily understood by reference to the drawings in which

FIGS. 2(A–C) show some early examples of mass spectra obtained with the apparatus of FIG. 1.

FIGS. 4(A–C) present results obtained with the apparatus of FIG. 3.

DETAILED DESCRIPTION OF THE INVENTION

Figure 1:
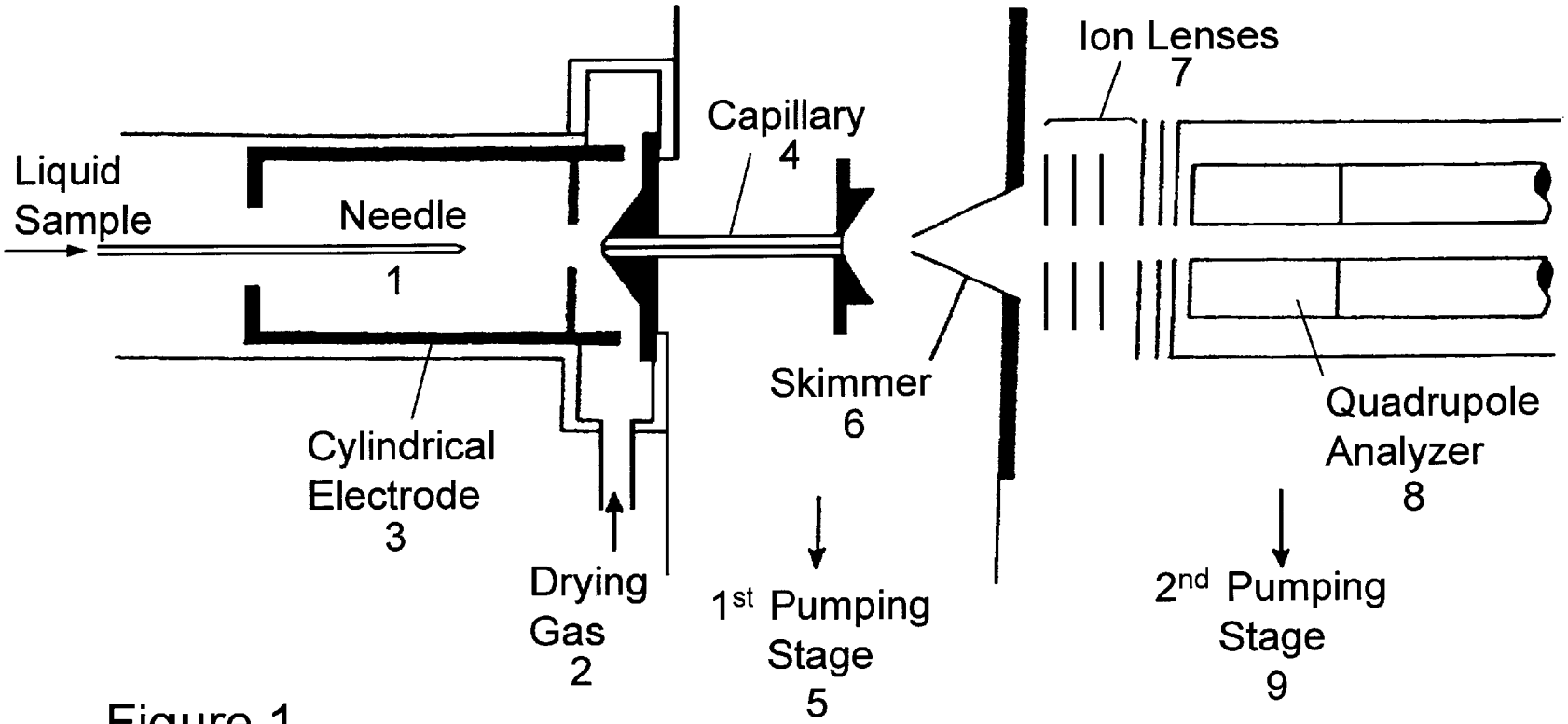
FIG. 1 is a schematic diagram of a typical Electrospray Ionization Mass Spectrometer with which the invention can be practiced.
Figure 2A:
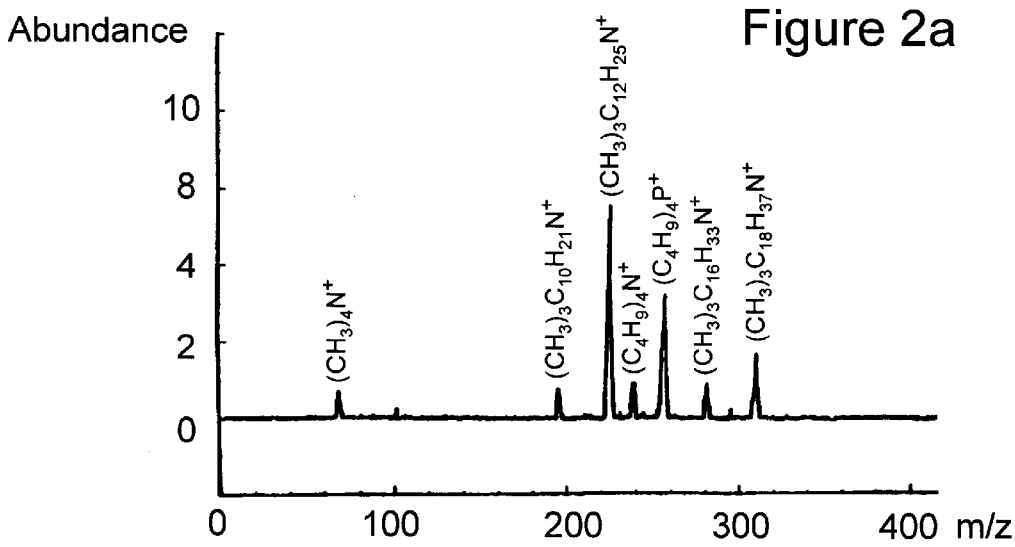
FIG. 2A shows the mass spectrum obtained with the apparatus of FIG. 1 for a mixture of tetra alkyl ammonium or phosphonium halides at concentrations from 2 to 10 ppm.
Figure 2B:
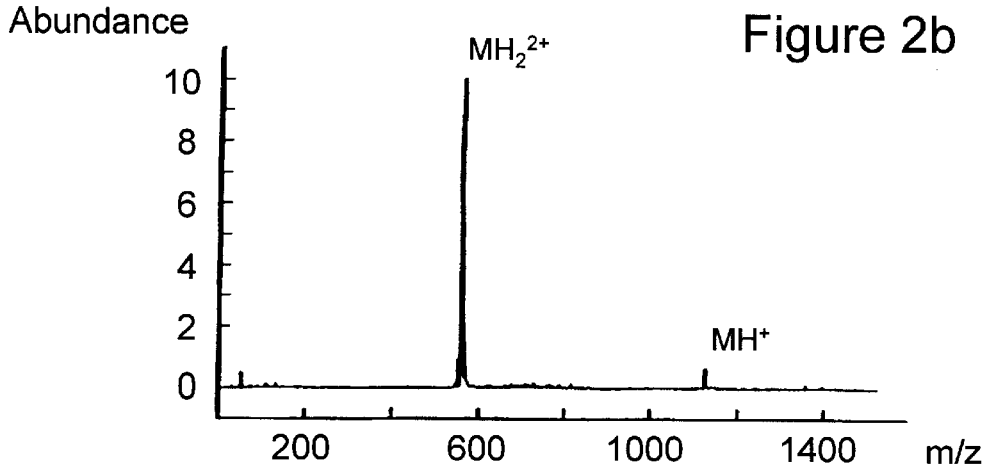
FIG. 2B is the mass spectrum for a solution of the decapetide gramicidin S in a mixture of methanol and water. It is interesting that the peak for a doubly charged ion is substantially larger than the peak for the singly charged ion.
Figure 2C:
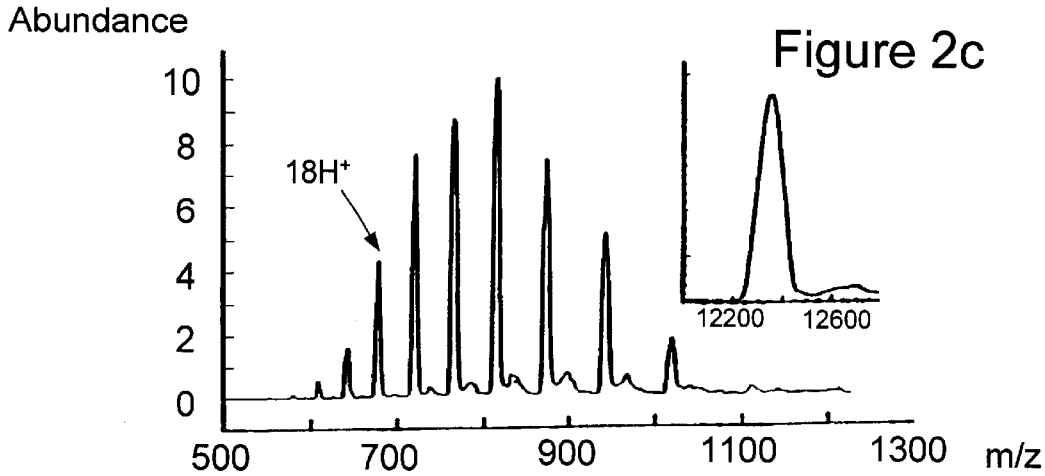
FIG. 2C shows the spectrum obtained with the apparatus of FIG. 1 for the protein cyctochrome-C. It illustrates the propensity of ESI to produce ions with multiple charges when the analyte species comprises a large polyatomic molecule.
Figure 3:
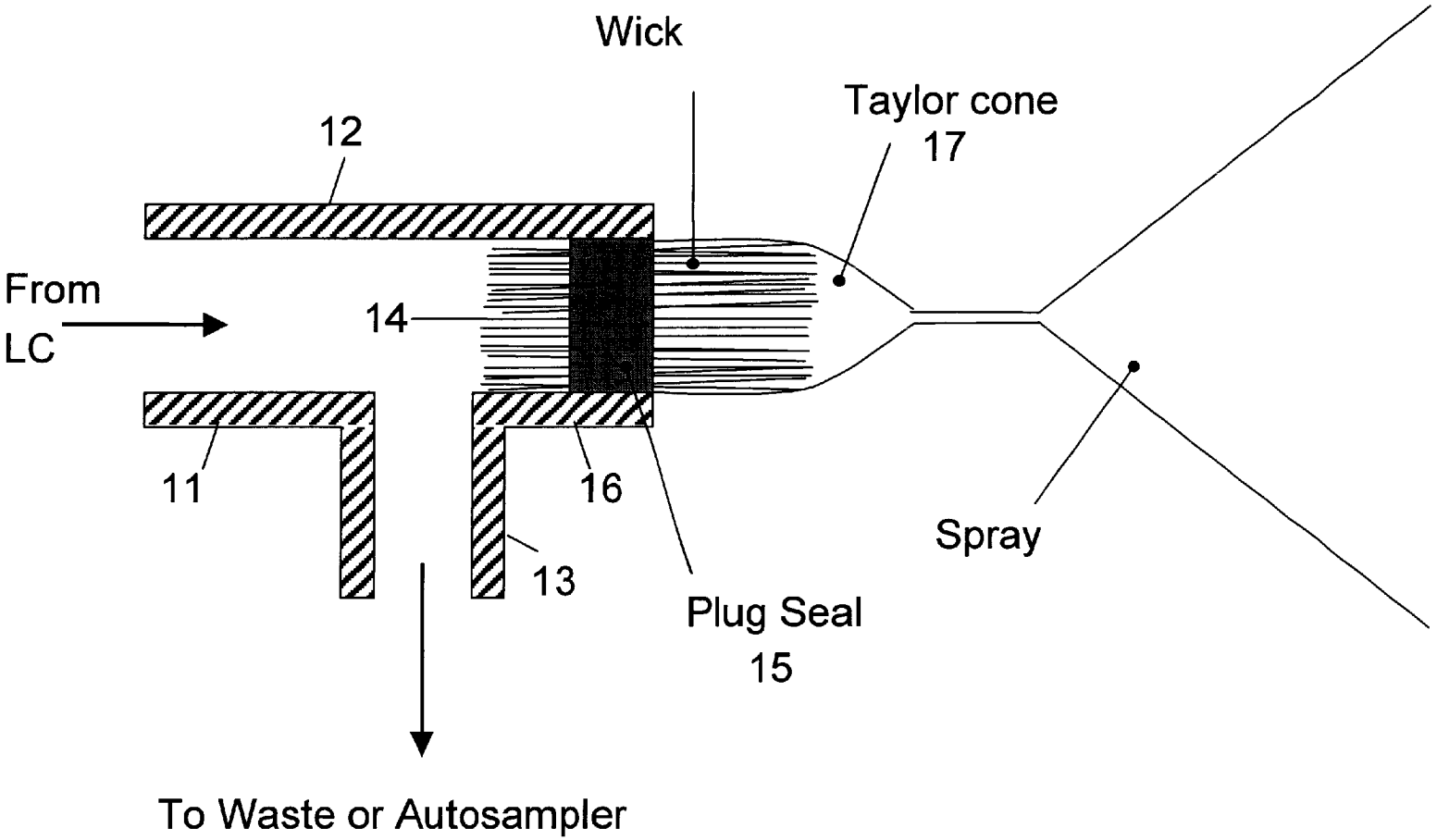
FIG. 3 shows the essential features of a preferred embodiment of the invention. It represents a wick-injector according to the invention that can be substituted for the injection needle of the conventional ES source shown in FIG.1.

The essential features of a preferred embodiment of the invention are shown schematically in FIG. 3 which represents a wick-injector according to the invention that can be substituted for the injection needle 1 of the conventional ES source shown in FIG. 1. (Component numbers below 10 relate to FIG. 1) A primary stream of sample liquid from any desired source such as a liquid chromatograph (not shown), enters arm 11 of tee 12 and exits through arm 13. This primary stream bathes one end of wick 14 that extends from the interior of tee 12 through plug-seal 15 at the end of arm 16 of tee 12 for any desired distance, typically 5 to 25 mm in many experiments. Plug-seal 15 prevents convective flow of sample liquid through arm 16 of tee 12 but allows a capillarity-driven flow of sample liquid through wick 14 to its tip which is located near the inlet of capillary tube 4 that passes ion-bearing gas from spray chamber 3 into first pumping stage 5 of the vacuum system containing mass analyzer 8 in second pumping stage 9 . When a suitable potential difference is applied between wick 14 and inlet of capillary tube 4, sample liquid forms Taylor cone 17 at the tip of wick 14. Liquid flow rates through wick 14 depend upon the structure, material, length and diameter of the wick, the composition of the liquid, as well as the voltage difference and the distance between the wick and the inlet face of capillary tube 4. When tee 12 is made of metal or other conducting material, the desired potential difference between wick and capillary tube can be maintained by connecting one pole of an appropriate power supply to capillary tube 4 or its housing in such a way that the inlet end or face of the tube is maintained at the potential of that pole. The other pole of the power supply can be connected directly to the tee, or one of the tubes through which the convective flow of sample liquid enters or leaves the tee. Alternatively, that other pole of the power supply can be connected to a small wire inserted into the wick or wrapped around it so as to establish good electrical contact with the wick liquid. Other ways of providing for good electrical contact with the wick tip will readily occur to those skilled in the art.

With a 3 cm length of unwaxed dental floss as the wick, we have maintained stable sprays with flow rates through the wick from as low as 30 nL/min or less to as high as 200 nL/min. Larger and smaller flows can be achieved respectively with larger and smaller wicks. For flow rates at the low end of this range, the fluid jets from the cones and the resulting droplets are often not visible because their diameters can be submicron in size. Even so they are presumed to be similar in form and function to the same components of cone-jet sprays at larger flow rates because measurable spray currents are obtained. Moreover, the mass spectra produced from sample liquids are very much the same whether they are sprayed from a wick at very low flow rates or at the usual flow rates of several uL/min from a conventional ES injection needle. In fact, the mass spectral peak heights are often higher for wick sprays at low flow rates than for conventional needle sprays at higher flow rates of the same solution.

Figure 4A:
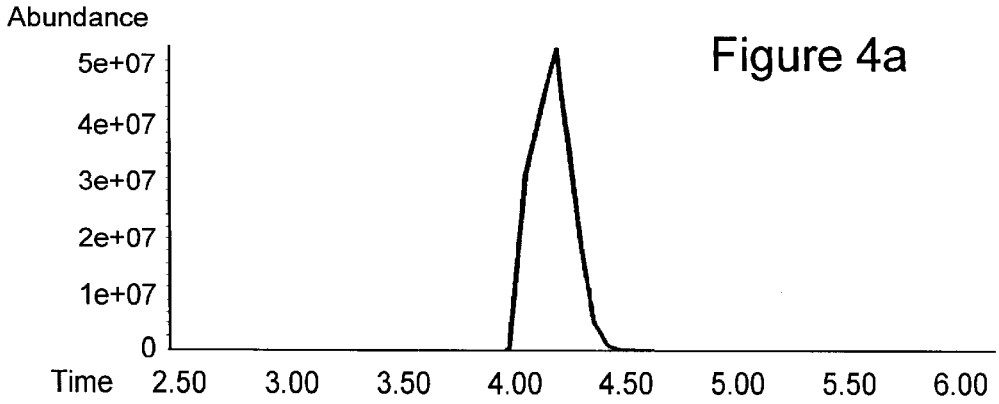
FIG. 4A shows a time-magnitude trace of the total ion current registered by the detector of a quadrupole mass spectrometer fitted with a commerical ES source. It was produced by injection of a 100 microliter "slug" of sample solution into a continuous stream of water flowing into the apparatus of FIG. 3 at a rate of one milliliter per minute. The sample solution comprised a 2.9 micromolal mixture of cytochrome c in 50—50 methanol water containing 0.5 percent of acetic acid.
Figure 4B:
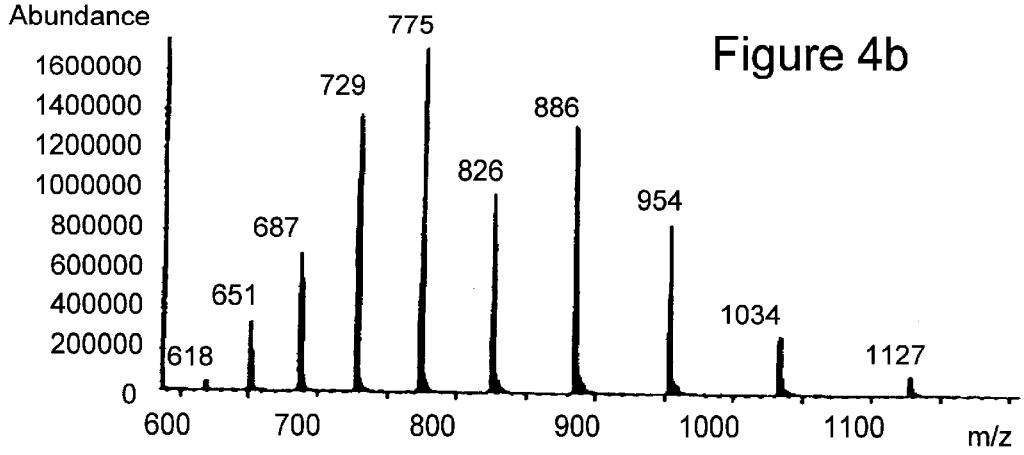
FIG. 4B shows a mass spectrum obtained in the apparatus of FIG. 3 for a steady continuous flow of the same solution of cytochrome-C of which a 100 microliter injection produced the time-current trace in FIG. 4A.
Figure 4C:
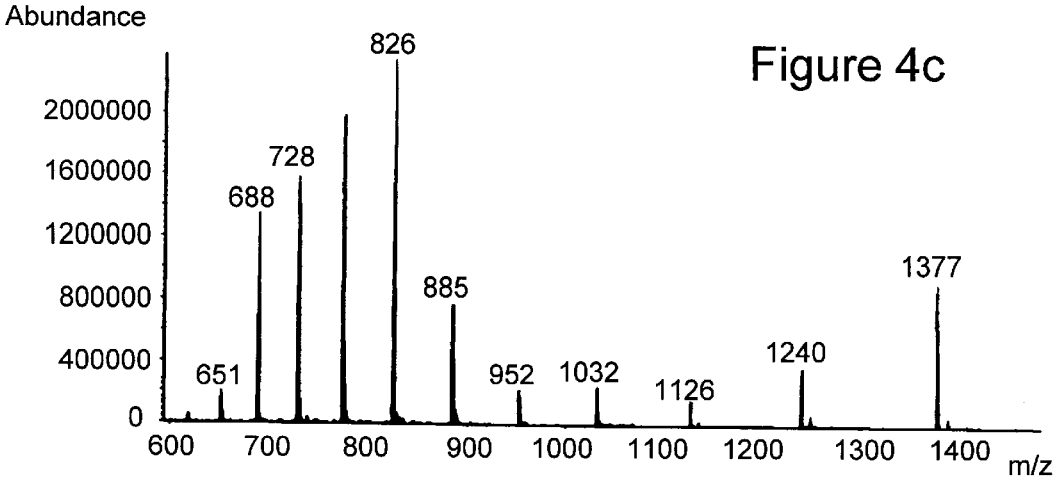
FIG. 4C shows the mass spectrum obtained during a four second segment of an injection identical with the one used to obtain the time-current trace of FIG. 4B.

Some of the advantages of this wick-spray invention are revealed in results obtained in a particular experiment that serves as an example of the practice of the invention. FIG. 4A shows a trace of total ion current registered by the detector of a quadrupole mass spectrometer (Nermag 3010) fitted with a commercial ES source (Analytica of Branford) similar in design to the source shown in FIG. 1 except that injection needle 1 was replaced by a wick injector like that of FIGS. 3 wherein wick 14 was a 20 mm length of unwaxed nylon dental floss. The trace of FIG. 4A was produced by a 100 uL injection of sample solution into a continuous primary stream of water flowing at a rate of one mL/min into arm 11 of tee 12 as shown in FIG. 4A. The sample solution comprised 2.9 uM cytochrome c in 50-methanol-water containing 0.5 per cent of acetic acid. This injection simulates the passage of an LC peak of six seconds duration in the effluent from an LC column operating with a mobile phase flow of one mL/min. The base width of the peak is about 30 seconds, roughly a factor of five bigger than the injection time. Such broadening indicates an appreciable dead volume that could be substantially reduced with even modest care in the design of the plumbing which was just jury rigged for this experiment. Repetitive injections indicated that the peaks for total ion current are highly reproducible. If the exit flow of excess liquid from the tee, i.e. over and above the flow withdrawn by the wick, were passed to an auto sampler, the contents of each such peak in an LC separation could readily be recovered for other purposes such as testing for bioactivity. FIG. 4B shows a mass spectrum obtained for the same solution with a conventional Analytica source and previously mentioned Nermag quadrupole mass analyzer. The spectrum was averaged for 70 sec during a steady flow at 2 uL/min of the same sample solution of cytochome C used to obtain the total ion current peak of FIG. 4A. The mass spectrum of FIG. 4C was obtained with the wick source of FIG. 3 during a 4 second segment of the injection that produced the total-ion-current trace of FIG. 4A. The distribution of peak heights in FIG. 4C between m/z values of 600 and 1000 is a bit more "normal" for this analyte than those of FIG. 4B. Moreover, most peaks of FIG. 4C are substantially higher than their counterparts in FIG. 4B. In other words the analytical sensitivity obtained in this experiment with the wick source at a primary flow of sample liquid of one ml/min is at least as high as, and apparently substantially higher than, can be obtained with an optimum flow of 2 uL/min in a conventional ES source. Many other experiments have confirmed this result, repeatedly showing that the analytical sensitivity with the wick source at flow rates of one ml/min or more is usually greater than can be obtained with a conventional ES source at customary low flow rates of one or two uL/min. Most if not all commercial ES sources claiming the ability to accommodate electrospray liquid flow rates as high as one ml/min always seem to show substantially lower analytical sensitivities than are obtained at the more conventional low flow rates of a few uL/min. Because the flow rate of sample liquid delivered through the wick to the spray by a wick source is determined by what happens after the liquid enters the wick there is no apparent upper limit to the primary flow rate of liquid to be analyzed. The wick is indifferent to the volume or flow velocity of the sample liquid in which its "inlet" section is immersed. Thus, the invention provides the possibility of simple sampling for continuous mass spectrometric monitoring of industrial process streams of any magnitude without any need for complex sampling valves or pumps. Indeed, wick extraction might well be able to provide convenient sampling of high volume flows for other kinds of sensors and analyzers that require or can accommodate to relatively flow flow rates of liquid to be analyzed.

A systematic study of wick structure and composition has not yet been carried out but we have had success with wicks comprising bundles of small fibers made of glass, graphite, paper, cotton and linen that have ranged in diameter from 8 to perhaps 200 microns. Nor is the cross sectional shape important. Thin flat strips of cloth or paper work just as well as threads or fibers of circular or oval cross section. Tubes packed with granular or porous material can also be used. An effective wick can comprise a single monofilament fiber in a tube whose bore has a diameter only slightly larger than that of the wick. If the thickness of the annular gap between wick and tube is sufficiently small, then capillarity can overcome gravity and lift the liquid to a substantial height above the surface level of the liquid in which this filament-cylinder wick is immerged. Of course, if liquid is to be electrosprayed from this or any other type of wick, the difference in height between inlet and outlet ends must small enough so that capillarity will raise the liquid to the level at which the applied electric field can pull it into the spray Unwaxed dental floss seems to work very well so a short length of this material has comprised the workhorse wick in the majority of our studies involving mass spectrometric analysis. In bench top experiments with electrometer measurements of total spray current we have readily obtained apparently-stable "sprays" with a wide variety of liquids. Gradually increasing the applied voltage results in a smooth very gradual transition to a corona discharge that seems to be readily reversible without the usual hysteresis loop. A most attractive feature wick sources is that they provide the enhanced analytical sensitivity of ESIMS at very low flow rates while accommodating large flow rates of primary liquid, e.g. through the tee of FIG. 3.

The results just described, along with those of many similar experiments, show that the wick injector of the invention, of which FIG. 3 schematically represents one embodiment, actually provides higher analytical sensitivity with sample liquid flowing into the source at a rate of one ml/min than the standard needle injector in a typical ES source can provide at the flow rates of one or two uL/min that are typical of conventional ES sources. Clearly, the reason for this increase in sensitivity is the very small rate of flow at which a wick of small diameter delivers liquid to the spray. Investigators who have studied electrospray dispersion of liquids have long recognized that the size of the charged droplets that are produced decreases with decreasing Flow rate into the spray. Indeed at flow rates much below one uL/min the droplets become so small that they are invisible. Such tiny droplets evaporate very rapidly and completely within in a very short distance from the tip of the Taylor cone. Consequently, the tip of the wick injector can be located very close to the aperture that passes the mixture of ions and bath gas, e.g. the inlet aperture of capillary tube 4 in FIG. 1. Therefore, the fraction of the total amount of analyte in the spray cone that is intercepted by the aperture, thus passing into the vacuum system and thus to the mass analyzer, is much larger than is the case for more conventional ES sources which typically operate at flow rates above one uL/min. At those higher flow rates the tip of the infection needle must be further back from the aperture so that the droplets, which are larger than those from a wick operating at much lower flow rates, will have time to evaporate. Consequently, the fraction of the spray cone that passes into the vacuum system for mass analysis is substantially smaller. When the flow rate of sample liquid into the cone-jet spray is small, the total flux of sample is small but the fraction of that total flux that is transformed into ions entering the analyzer is large. In sum, the ratio of mass spectrometer signal to the mass of analyte required and consumed, i.e. the analytical sensitivity and efficiency, can be much larger with the small sample flow rate that a wick injector can provide, than with the higher sample flow rates of conventional ES sources. Indeed, in many of those conventional sources, especially those that do not use a counter current gas flow to desolvate the droplets and ions, it is customary to offset the injection needle from the axis of the aperture leading to the vacuum system. The reason for this offset is that the droplets on the periphery of the spray cone are usually substantially smaller than those nearer the spray axis. Moreover, the drying gas in that peripheral region has less solvent vapor. Both of these characteristics mean more rapid and more complete vaporization of the droplets, higher ionization efficiency and thus higher ion currents at the detector, even though the quantity of analyte that enters the vacuum system is very small.

The advantages of ESI with very low flow rates to obtain small droplets and high sensitivity have gained much attention since M. S. Wilm and M. Mann [Int. J. Mass Spectrom Ion Proc. 136, 167 (1994)] introduced injectors of small bore glass or quartz tubing with ends drawn out to fine tips by "pulling" techniques long used by cell biologists to make tiny probes and "clamps". The inside diameters of these drawn needles can be as small as one or two microns. A thin metal coating applied to the outside surface of the glass down to the tip provides electrical contact with the emerging solution. A desired quantity of sample solution is injected into the large bore end and gas pressure is applied until liquid starts emerging from the tip, after which the pressure can be relieved. By means of a wire clamped to the metal-coated exterior of the injector needle and connected to a power supply an appropriate potential difference can be maintained between liquid emerging from the tip and the inlet aperture of a tube or orifice leading into the vacuum system. Flow rates as low as a few nanoliters per minute give rise to an extremely fine spray which can consume as little as one microliter of sample solution in 45 minutes or more. After the spray starts the liquid flows by capillarity alone, just as in the wick source of the invention. Dubbed "nano-spray" this technique has been widely adopted and several companies are now providing the metallized needles ready for use. Although this nanospray technique may at first glance seem very similar to the wick injectors of the invention, the latter offer some substantial advantages:

1. In order to start the flow of liquid and thus the spray with these glass silica needles one must sometimes pressurize the liquid with a gas or a deliberately fracture a bit of the tip by crushing it slightly against a hard surface. Flow in the wicks of the invention starts automatically as soon as they are wet by sample liquid and the electric field is turned on.

2. Because the exit aperture of a nanospray tube is so small, one must exercise extreme care in avoiding the presence of any particulate matter in the liquid sample used to load the probe. Even when precautions are taken to eliminate particle, it only takes one stray particle to obstruct the flow so that in practice plugging is still a problem. The nature of the wick is that the area over which liquid can enter the wick by capillarity is very large so that very close packing of a large number of particles would be required to prevent liquid from reaching the wick interior. Thus, the external surface of the wick filters out or exludes particles from interior passages through which the liquid passes to reach the tip the electric field disperses it into the small droples of the spray. Thus no special care is needed in preventing particulates from being included in the sample liquid during its preparation. Plugging has never been a problem.

3. The bore of the needle tip on a nanospray injector is much smaller than the bore of the tube from which the needle is drawn and into which sample liquid is introduced. Thus, the flow velocity during operation is very much smaller in the large bore part of the needle upstream than in the much smaller bore of the needle at the tip. A long time is thus required for the small flow through the tip to remove any appreciable amount of fluid from the large bore section. No way has yet been found to couple one of these needles with an LC column so that the liquid composition in the spray can respond quickly to composition changes in the effluent from the LC column. In the wick injector of the invention, the dead volume is minimal and the flow velocity is uniform throughout its length. Consequently the response time of the wick injector is fast enough so that chromatograph peaks only a few seconds wide and a few seconds apart can be sampled into an electrospray mass spectrometer in rapid succession with minimal change in the composition-time dependence. Such responsive sampling of large LC effluent is not yet possible with nanospray injectors now available.

Worthy of note in FIG. 4C is the appearance of peaks in the spectrum at m/z values above 1127 that did not show in the reference spectrum of 4B. As pointed out above, the 4C spectrum was obtained during the middle four seconds of the TIC peak in Panel 4A. In a spectrum taken during the first few seconds of the TIC peak duration the peaks at the higher m/z values 4C do not appear. In a spectrum taken during last few seconds the peaks at lower m/z values are substantially more prominent than in FIG. 4C. The m/z values and the spacing of all the peaks in both spectra leave no doubt that they all are due to protonated ions of cytochrome C. Thus, the question arises as to why the ions with the highest m/z values showed up in FIG. 4C but not in FIG. 4B. We believe that these differences can be accounted for by the following scenario. Chowdhury et al [J. Am. Chem. Soc. 12, 9012 (1990)] found that when cytochrome C molecules have a folded or compact conformation in solution, their ES ions have fewer charges than when the molecules in the solution are in an unfolded or denatured conformation. The solution used to obtain the reference spectrum in FIG. 4B comprised a methanol-water solution of cytochrome C in which the protein molecules were denatured (unfolded) by the alcohol. Thus, the numbers of charges on its ES ions were high enough so that their corresponding peaks in FIG. 4B all had m/Z values less than 1127. The spectrum of FIG. 4C, on the other hand, was obtained when a 100 uL sample slug of that same solution was injected into a stream of pure water flowing at 1 mL/min flow. When that slug of methanol-water solution passed through the wick the chromatographic retention time of the solute protein on the wick was longer than the retention time of the methanol. Thus, some of these protein molecules were retained long enough to elute into the pure water that followed the slug of sample solution that was injected. In the absence of methanol enough of them were able to refold by the time they were transformed into ions in the electrospray. The ions from these refolded molecules had fewer charges than their denatured counterparts and thus account for the peaks at m/z values above 1127 in FIG. 4C. This admittedly speculative explanation is at least consistent with the results shown in FIGS. 4B and 4C. It is given further credence by two additional observations. The spectrum obtained during the first four seconds of the peak of FIG. 4A showed no evidence of ions with m/z values above 1127. The spectrum obtained during the last four seconds of that peak showed a substantially greater abundance of ions with m/z values below 1127 than are seen in the spectrum of FIG. 4C which was obtained near the middle of the peak. The ions with m/z value below 1127 have fewer charges because their parent molecules had a more compact conformation. In the experiment of FIG. 4 C the solvent of the injected sample was 50—50 methanol-water in which the protein molecules were denatured with a less compact conformation and would be expected to have more charges and thus m/z values below 1127. In units of time the base width of the injection peak in Panel B is 2.7 times the injection time, suggesting some retention of the protein molecules by the wick substance. This "suggestion" is confirmed by our finding that if the the wick is shortened, the width of the peak decreases. Moreover, the peak is appreciably narrower when insulin is the analyte, all other things being the same. Insulin is a much smaller molecule than cytochrome C and would seem likely to have a shorter retention time in the wick. The mobile phase into which the sample solution was injected was pure water. Thus, the retained molecules desorbing from the cellulose during the last few seconds of peak duration would find themselves in nearly pure water and would fold up to become more compact. Therefore, they would have fewer charges when they desorbed from their ES droplets which also would be mostly water. This scenario is speculative but it is entirely consistent with our finding that the peaks for ions with higher m/z values (lower charge states) were always relatively higher in spectra taken during the later stages of injection of sample solution into the primary flow of pure water. This scenario is also consistent with the observation that with short wicks the peaks at higher m/z values are much less pronounced. Indeed when the wick was shortened to a length of 5 mm there were no discernible peaks with m/z values above 1127. The reason that shorter wicks provide fewer ions with high m/z values is simply their decreased capacity for adsorbing solute molecules. The only protein molecules that can desorb into pure water are those already adsorbed on the wick when the passing solvent mobile phase changes to pure water from methanol-water. For the 5 mm wick the amount of protein in the wick that could desorb into water, and thus refold to produce ions with low charge states, was so small that peaks due to those low-charge-state ions were hardly visible in the spectrum.

Implicit in the results just described is the idea that the wick was providing some chromatographic retention analogous to what happens in so-called paper chromatography. In that technique some analyte sample (usually in solution) is deposited as a "spot" on a strip of paper near one end. "Development" of a chromatogram is then brought about by suspending the paper strip above a pool of a solvent into which the spot end is dipped. Driven by capillarity the solvent mobile phase begins to migrate up through the paper strip toward the far upper end. The species in the deposited spot of sample desorb into the advancing solvent mobile phase and are carried along with the flow of liquid but at a lower average velocity relative to the paper than the liquid. This velocity lag or slip of the solute molecules relative to the liquid is due to their repeated adsorption to, and subsequent desorption from, the paper substance. Because they are retained at rest on the paper for a short time between each adsorption and desorption their net forward (upward) progress is perforce less than that of the liquid. In general the characteristic time of this chromatographic retention, and therefore the effective upward velocity of the solute, is different for each species. Consequently, when the capillarity-driven flow of the liquid stops, (e.g. when the front reaches the upper end of the paper strip or the bottom end is removed from the pool of liquid), each species of the original sample will occupy a somewhat diffuse spot at a different location (height) on the strip. The combination of liquid pool and sample-bearing paper strip is often enclosed in a case or housing so that the surrounding gas is saturated with liquid vapor, thereby preventing evaporation that would dry out the strip and stop the action. When this development process has proceeded as far as it can, or to an earlier satisfactory extent, the strip, which comprises a chromatogram of the sample species, is removed from the enclosure.

As background for interpreting such a paper chromatogram it is first appropriate to recall what happens in column chromatography of liquids. In those techniques the retention time for a species in the column is the interval between injection of sample at the column inlet and emergence from the column exit of the peak containing that species. Methods for detecting that emergence include among others: spectral absorption or fluorescence, electrical conductivity, voltammetry, and mass spectrometry. The latter is generally the most complex and expensive but has the great advantage of providing fairly positive identification of almost any peak species. Whatever the detction method, the relative magnitude of the detector signal (peak height) for each species is taken as a measure of its relative abundance in the injected sample.

To "read" such a paper chromatogram one must somehow determine the loci of the spots or bands for the separated species. A number of methods have been used to make the spots visible so their location can be determined. The include illumination with radiation of appropriate wavelength to make the analyte species fluoresce or to enhance differences in relectance or absorbance of the spot. Sometimes application of a reagent solution can react with analytes of interest to produce changes in color. If one or more of the analyte species contains radioactive isotopes, one can image the chromatogram with photographic film or scan it with a counter. By whatever method may be used the location of an analyte species on the paper strip is the counterpart of the retention time of a peak in conventional gas or liquid chromatography. The PC "retention time" is thus inversely proportional to the distance of a species spot from the point of deposition of the sample on the strip. In the absence of any other information that distance is the only measure of a species identity.

"Paper chromatography" (PC) as just described, was once in widespread use but has now been largely supplanted by so-called "Thin Layer Chromatography" (TLC) which is an exactly analogous procedure except that the stationary phase is a granular solid distributed in a thin layer on the surface of a plate, usually made of glass or plastic. Clearly, this stationary phase must be wettable by the mobile phase so that the latter is indeed mobile by virtue of capillarity. Flow of the mobile phase in conventional liquid chromatography is usually maintained by application of sufficiently large pressure differences across the column. Even when the stationary phase is not wettable by the mobile phase, as is the case in so-called "reverse-phase LC," a high pressure difference can maintain flow through the column and bring about intimate contact between the two phases. The use of high pressure to maintain the flow of mobile phase through the stationary phase also allows one to increase resolving power by using long columns. In PC or TLC the migration velocity of capillarity-driven flow decreases with increasing distance from the source liquid. Consequently, the effective length of the separating region, and therefore the resolving power, are limited to much lower values than can be achieved in LC. However, so-called "forced flow" development techniques based on centrigfugal force or hydrostatic pressure are being developed and promise to enhance the latter's resolving power. Even without such enhancement PC and TLC are widely used because of their convenience, simplicity, and economy In particular, by appropriate spacing of the spots at which analyte samples are deposited on the plate or a broad strip of paper one can simultaneously carry out separation in several parallel channels on the same plate or sheet of paper. This multiplexing ability has led to very wide use of TLC in situations where a great number of samples need to be examined and a high resolving power is not required. e.g. for quality control on production lines to determine whether process product is within specifications.

However, it is always advantageous and sometimes necessary to obtain more positive identification of a peak or spot species on a PC. For this purpose mass spectrometry would be the most informative and versatile detection method but till now there has been no routine and simple method for applying the virtues of MS detection to the identification of spot species on a PC or TLC chromatogram. A similar problem occurs when one wants to identify the species in a spot or band on a gel electrophoresis plate. Some success has been obtained in these situations by excising the stationary phase material, along with its adsorbate, from a spot on the plate, mixing it with a small amount of appropriate solvent, and removing the stationary phase material by filtration or centrifugation. The resulting solution can then be analyzed by ESMS to identify the spot species. Alternatively, one can apply some solvent to the spot or band and then "blot" some of the resulting solution into a piece of paper from which the absorbed sample species can be eluted with solvent. The resulting solution is then electrosprayed into a mass spectrometer system.

These excising and eluting procedures are effective but relatively slow and awkward to carry out. They require great care because the amount of analyte in the spot is so small. An advantage of the invention is that one can in press a short length of wick, e.g. a strip of paper, cloth or other material, against a spot on the plate to which a drop of solvent has been applied. Capillarity will suck some of the resulting spot solution into the wick which can then be removed. One end of the wick can then be immersed in a small pool of appropriate solvent and the other end positioned in front of an aperture leading into a vacuum system containing a mass analyzer as has been described. One pole of a power supply is then connected to the wick, either directly by means of a small wire or strip of metal foil, or indirectly through the pool of solvent in to which the end of the wick is immersed. The other pole of the power supply is connected to the tube or plate housing the aperture. At a sufficiently high potential difference between the wick and the aperture solution will be electrosprayed from the wick to produce ions that will be entrained in the gas entering the aperture and thus transported to the mass analyzer for interrogation.

Indeed, one can similarly apply a strong field to the end of the paper strip or TLC through which capillarity is maintaining a flow of mobile phase liquid during development of the chromatogram. The field then electrosprays the liquid off the end of the strip to providing ions for mass analysis of analyte in a spot or band as it arrives. It is desirable to chamfer the end of the strip to provide a fairly sharp tip or point at which both the liquid stream lines and electric field lines will converge, thereby providing a well defined origin for the spray. Thus the paper strip or TLC plate becomes the "wick" of FIG. 1 through which separated analyte species in solution are introduced one at a time into the electrospray from which they emerge as ions. Some of those ions pass through the aperture into the vacuum system for analysis by an appropriate mass analyzer. In sum, the process is the counterpart of a standard LC-MS arrangement in which the customary LC has been replaced by the strip of paper or TLC plate through which mobile phase moves by capillarity. This procedure, as described, provides MS detection and identification of every species in the original sample, just as is the case in conventional LC-MS. Clearly, this procedure cannot very well be simultaneously carried out on each of a multiplicity of parallel channels on a single plate or sheet of paper. But it is straightforward to cut a strip containing a channel of interest from the plate or sheet of paper and carry on the ESMS procedure on that strip and subsequently on as many of the other such strips as needed. Such a complete analysis can take a substantial amount of time and is not always necessary or desirable. It can happen that one wants positive identification of species in only one or two spots on the developed chromatogram. One then has merely to "blot" some of the spot species on to a separate short strip of paper, dip one end of that strip into a source of solvent mobile phase and electrospray that solvent mobile phase off the other end of the strip into the vacuum system containing a mass spectrometer. Alternatively, one can cut out from the sheet or plate a small section that contains the spot or spots of interest and carry out the procedure on that section alone.

The need for analysis of analyte in one or more particular spots on a PC or TLC chromatogram may become apparent only sometime after it had been developed. In such a situation the PC and TLC technique shows another substantial advantage relative to conventional LC. Because the paper and the plates are very inexpensive and compact it becomes feasible to dry and store any or all chromatograms for future reference. Then one can at any time and retrieve any stored chromatogram, and apply the above-described methods to one or more of its sections. Other variations on these general themes will be obvious to those skilled in the art.

We claim:

1. A method for characterizing solute species in a liquid solution which comprises the following essential steps:

(a) immersing the entrance end of a wick element in said liquid solution, said liquid solution comprising at least one solute species in a vaporizable solvent, said wick element comprising a porous permeable aggregate of material that is wettable by said liquid solution so that capillarity causes said solution to migrate through said wick to the exit end opposite from the entrance end immersed in said liquid solution, (b) maintaining, as in conventional electrospray ionization, a potential difference between said wick and its surroundings that is large enough to produce at the exit end of said wick element an electric field sufficiently intense to disperse the arriving liquid into ambient bath gas as a fine spray of charged droplets, said ambient gas being maintained at a pressure sufficiently high to prevent formation of an electrical discharge in said gas by said electric field, (c) allowing solvent to evaporate from such charged droplets, thereby producing gaseous ions from at least some of said solute species, (d) characterizing said gaseous solute ions by measurement of at least one of their properties.

2. A method as in claim 1 in which the said gaseous ions of solute species are characterized by mass analysis in which the mass/charge ratios of the ions are measured.

3. A method as in claim 1 in which the said gaseous ions of solute species are characterized by measurements of their mobilities in a bath gas comprising neutral molecules.

4. A method as in claim 1 in which said wick comprises a porous permeable aggregate of wettable fibers chosen from the class comprising natural fibers, synthetic organic fibers and synthetic fibers of inorganic materials.

5. A method as in claim 1 in which said wick comprises a porous permeable aggregate of wettable particles small enough so that capillarity will result in migration of the liquid through the interstices between the particles.

6. A method as in claim 1 in which the liquid solution containing the solute species to be characterized comprises the effluent from a separation procedure chosen from the class of such procedures that includes chromatography, electro-chromatography, and electrophoresis.

7. A method as in claim 1 in which the liquid containing the solute species to be characterized, and into which the entrance end of the wick is immersed, comprises a flowing stream such that temporal variations in the composition of said stream are reflected in a corresponding temporal variation in the character of the gaseous solute ions as determined by said method of characterizing said gaseous solute ions.

8. In the well established apparatus and procedures of Electrospray Ionization Mass Spectrometry (ESIMS), wherein sample solution is injected into a region of intense electric field through a small bore capillary tube, the improvement which comprises replacing said small bore capillary tube by a wick comprising an aggregate of porous permeable material wettable by the sample solution so that said sample solution migrates by capillarity through said wick from its entrance end immersed in said sample solution to its exit end in the region of intense electric field where the emerging sample solution is dispersed by said intense electric field into bath gas as a fine spray of charged droplets.

9. An apparatus for characterizing solute species in a solution comprising said solute species dissolved in a vaporizable solvent, said apparatus comprising as essential components:

(a) a means for providing a region containing an intense electric field, (b) a means for supplying said solution of solute species in a vaporizable solvent from a primary source to said region containing said intense electric field so that said liquid is dispersed as a fine spray of charged droplets into an ambient bath gas, said means of supplying said solution to said high field region comprising a wick element through which said liquid migrates by capillarity from an entrance end immersed in said liquid, to an exit end in the high field region where said high field disperses the emerging liquid into said fine spray of charged droplets, said wick element comprising a porous permeable aggregate of material wettable by said solution, c) a means for providing a flow of dry bath gas into said high field region to facilitate evaporation of solvent from said charged droplets, (d) a means of characterizing the ions formed when solvent from said charged droplets of said solution of said solute species evaporates into said ambient bath gas.

10. An apparatus as in claim 9 in which said means of supplying said solution of solute species to said high field region is a wick comprising a porous permeable aggregate of particulate material wettable by said solution.

11. An apparatus as in claim 9 in which said means of characterizing said ions comprises a mass analyzer that measures the mass/charge ratios of said ions.

12. An apparatus as in claim 9 in which said means of characterizing said ions comprises a mobility analyzer that measures the velocity with which an ion moves through a gas of neutral molecules in response to a an applied field of known intensity.

13. In any of the varieties of apparatus that are widely used for practicing the well established technique of Electrospray Ionization Mass Spectrometry (ESIM) and in which the solution to be analyzed is injected into the high field region through a small bore capillary tube, the improvement by which said small bore capillary tube is replaced by a wick element comprising an aggregate of porous permeable material that is wettable by said solution and through which said solution migrates by capillarity from its entrance end immersed in said solution to its exit end from which said solution emerges into said high field region to become dispersed as a fine spray of highly charged droplets into a dry bath gas.

14. In the practice of Thin Layer Chromatography the improvement by which during development of the chromatogram the end of the chromatographic strip, remote from the end immersed in mobile phase solvent, is exposed to an intense electric field that disperses arriving mobile phase as a fine spray of charged droplets into ambient dry bath gas wherein solvent evaporation from said droplets produces gaseous ions of sample solute species that can be characterized by mass and mobility analyses to provide information on the identity of the solute species giving rise to said ions.

15. In the practice of Paper Chromatography, as in the practice of Thin Layer Chromatoraphy described in claim 14, the improvement; by which during development of the chromatogram the end of the paper strip remote from the end immersed in mobile phase solvent is exposed to an intense electric field that disperses arriving mobile phase as a fine spray of charged droplets into ambient bath gas wherein evaporation of solvent from said droplets produces gaseous ions of sample solute species that can be characterized by mass analysis and mobility analysis to provide information on the identity of the solute species giving rise to said ions.

16. In the practice of Thin Layer Chromatography the improvement that provides information on the identity of a species in a particular zone on a thin layer chromatogram by execution of the following steps:

(a) pressing an area in the midsection of a strip of paper or other porous permeable material wet with a suitable solvents against the section of chromatogram occupied by the zone containing the species to be identified, (b) immersing one end of said strip in a pool of said suitable solvent and inserting the other end of said strip into a bath gas in which a nearby electrode at high potential relative to said pool of suitable solvent produces an intense electric field at the end of said strip of paper or other porous permeable material that is immersed in said bath gas, said electric field dispersing as a fine spray of charged droplets into said gas the solution that arrives at the end of said paper strip due to capillarity induced migration through said strip, said droplets containing solute species from the zone of interest on said chromatogram dissolved in said solvent, (c) allowing evaporation of solvent into said bath gas from said charged droplets to produce gaseous ions of said solute species from said zone of interest on said chromatogram, (d) characterizing said gaseous ions by mass and/or mobility analysis, obtaining information on the identity of said solute species.

17. In the practice of paper chromatography the improvement that provides information on the identity of a species in a particular zone on a paper chromatogram by execution of the following steps:

(a) pressing an area in the midsection of a strip of paper or other porous permeable material wet with a suitable solvent, against the section of chromatogram occupied by the zone containing the species to be identified, (b) immersing one end of said strip in a pool of said suitable solvent and inserting the other end of said strip into a bath gas in which a nearby electrode at high potential relative to said pool of suitable solvent produces an intense electric field at the end of said strip of paper or other porous permeable material that is immersed in said bath gas, said electric field dispersing as a fine spray of charged droplets into said gas the solution that arrives at the end of said paper strip due to capillarity induced migration through said strip, said droplets containing solute species from the zone of interest on said chromatogram dissolved in said solvent, c) allowing evaporation of solvent into said bath gas from said charged droplets to produce gaseous ions of said solute species from said zone of interest on said chromatogram, (d) characterizing said gaseous ions by mass and/or mobility analysis, thus obtaining information on the identity of said solute species.

* * * * *